United States Patent [19]

Rees

[11] 4,081,863

[45] Mar. 28, 1978

[54] METHOD AND VALVE APPARATUS FOR HOMOGENIZING FLUID EMULSIONS AND DISPERSIONS AND CONTROLLING HOMOGENIZING EFFICIENCY AND UNIFORMITY OF PROCESSED PARTICLES

[75] Inventor: Lancelot H. Rees, Westwood, Mass.

[73] Assignee: Gaulin Corporation, Everett, Mass.

[21] Appl. No.: 705,475

[22] Filed: Jul. 15, 1976

[30] Foreign Application Priority Data

Jul. 23, 1975 United Kingdom ..... 30859/75

[51] Int. Cl.[2] ..... B01F 15/02; B01F 5/06

[52] U.S. Cl. ..... 366/176; 366/192; 366/340; 251/212

[58] Field of Search ..... 259/4 R, 1 R, 18, 36, 259/2, DIG. 44, DIG. 41; 138/46, 42; 251/212

[56] References Cited

U.S. PATENT DOCUMENTS

| | | | |
|---|---|---|---|
| 1,036,274 | 8/1912 | Langer | 251/212 |
| 2,649,272 | 8/1953 | Barbato | 251/212 |
| 3,170,483 | 2/1965 | Milroy | 251/212 |
| 3,356,345 | 12/1967 | Goodman | 259/4 R |
| 3,408,050 | 10/1968 | Jacobs | 259/4 R |

*Primary Examiner*—Robert W. Jenkins

[57] ABSTRACT

A method for homogenizing fluid emulsions and dispersions is carried out by introducing fluid in a range of pressures of from 500 p.s.i. up to 12,000 p.s.i. into a valve structure having a homogenizing aperture characterized by similar inlet and outlet openings and a connecting passageway whose cross-sectional area is constant at all points therealong. Fluid is conducted through the passageway of constant cross-sectional area in a substantially linear path of flow to produce an energy release which is a function of the length of the passageway, i.e., product travel distance and the spacing of opposite wall portions of the passageway. In one desirable mode, the homogenizing aperture may be in the form of a slit.

The method is free from problems attributable to radial divergence of flow occurring in all sizes of conventional homogenizing apertures of circular section, and the linear flow type valve of the invention may be effectively employed in a wide range of pressures and flow rates. The valve structure may be made with adjustable component parts so that the length of the passageway, as well as its volume and shape, may be varied in accordance with differing characteristics of fluids to be processed. For processing some fluids, an impingement member or target may be mounted in spaced relation to the outlet opening of the aperture to provide an impingement surface against which the linear flow of energized fluid may be impacted to carry out a further energy release and extend homogenizing efficiency.

5 Claims, 21 Drawing Figures

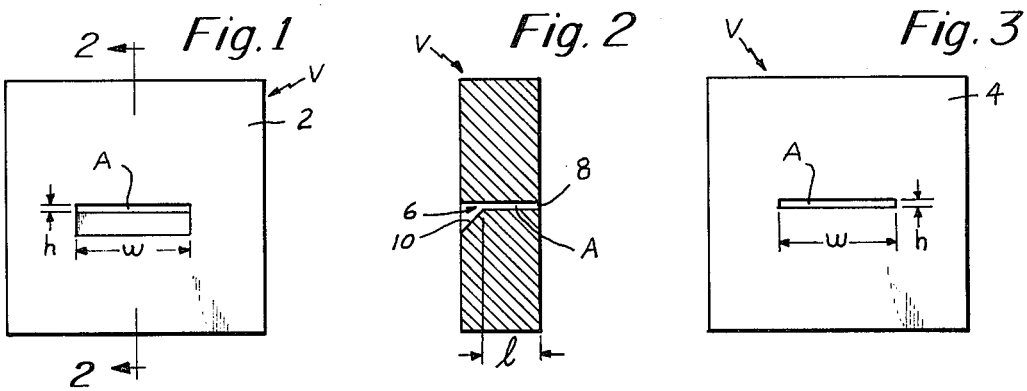
Fig. 1
2
V
2
A
h
w
2
Fig. 2
V
8
6
10
A
ℓ
Fig. 3
V
4
A
w
h
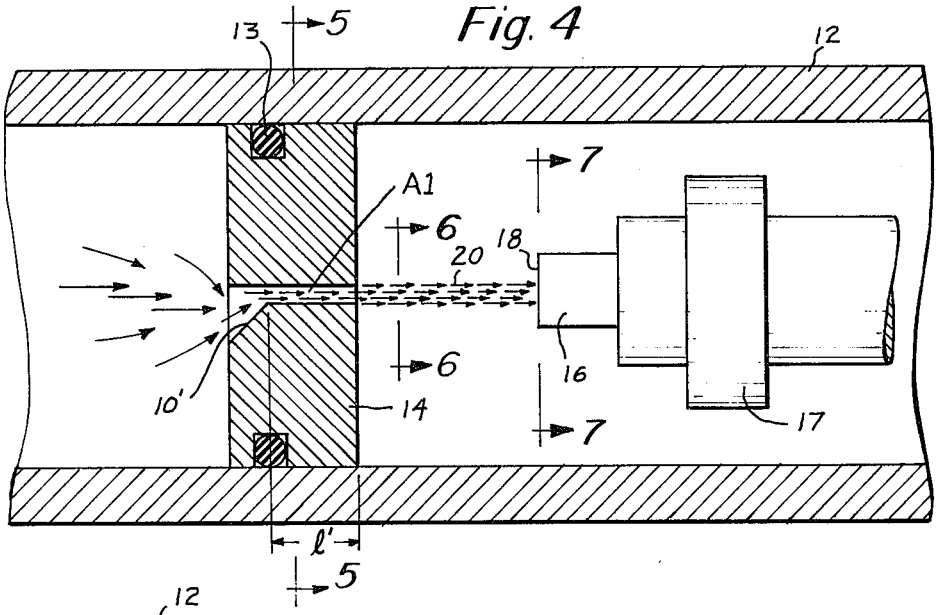
Fig. 4
13
5
12
A1
7
6
20
18
6
16
10'
14
7
17
ℓ'
5
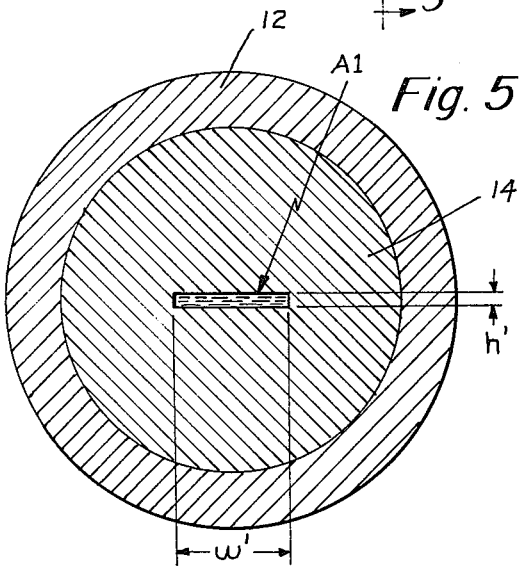
12
A1
Fig. 5
14
h'
w'
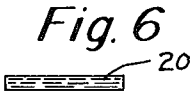
Fig. 6
20
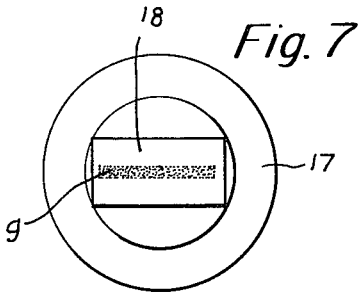
18
Fig. 7
17
g
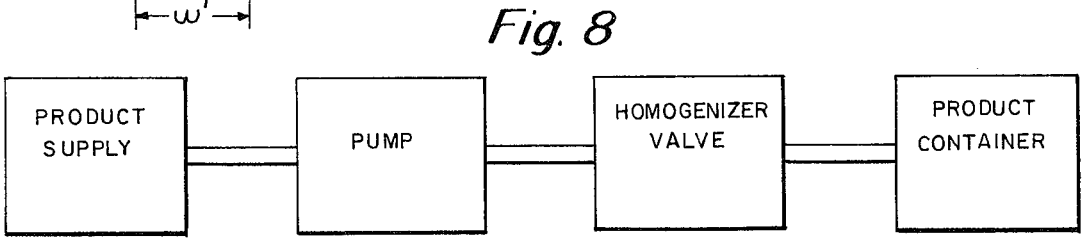
Fig. 8
PRODUCT SUPPLY
PUMP
HOMOGENIZER VALVE
PRODUCT CONTAINER

EFFECT OF BACK PRESSURE

METHOD AND VALVE APPARATUS FOR HOMOGENIZING FLUID EMULSIONS AND DISPERSIONS AND CONTROLLING HOMOGENIZING EFFICIENCY AND UNIFORMITY OF PROCESSED PARTICLES

BACKGROUND OF THE INVENTION

In the field of standard homogenizing where high pressure in a range of from 500 p.s.i. up to 12,000 p.s.i. is the source of energy, as distinguished from high speed mixers and colloid mills where no appreciable pressure is utilized, problems are encountered. One such problem is the occurrence of radial divergence of fluid flow and is due in part to the fact that almost all conventional valves of any consequence are of circular cross section and are made with an inner diameter of one size and an outer diameter of a larger size.

Typical of standard valves of this construction are homogenizing structures disclosed in U.S. Pat. Nos. 2,504,678; 2,242,809; 2,304,689; 2,882,025; 2,137,854.

Fluid material under pressure is fed through a hole in a valve seat element and flow is restricted by a matching valve member having a surface parallel to that of the valve seat. Pressurized fluid flows from the hole, commonly referred to as the inner aperture diameter, outwardly to become impacted against an impingement ring which surrounds an outer larger diameter of the aperture, and a radial divergence of flow takes place. This radial divergence of flow produces second and third degree phenomena in the pressure gradients which vary with the ratio of the outer diameter of the aperture to its inner diameter. This may affect any particular material being processed at any given flow rate with troublesome results.

Because of the conditions which may result from radial divergence, it is virtually impossible to extrapolate the results and behavior obtained in a valve with one size and configuration to that of another similar configuration of different size and flow rate requirements. In some cases, similar effects on the material being processed can be obtained from different output, but only after trial and error procedures which may be time-consuming and expensive, and in some instances, impractical. Another problem which is believed to be due to radial divergence of flow has to do with the need for supplying a conduit system, and a controllable back pressure must be maintained to obtain homogenizing efficiency of a satisfactory nature. Still another problem is the drop in efficiency at very high and very low flow rates.

SUMMARY OF THE INVENTION

The present invention relates to an improved method and valve apparatus for homogenizing fluid emulsions and dispersions and is concerned particularly with the problems associated with radial divergence of flow in conventional homogenizing valves.

It is a chief object of the invention to improve homogenizing valve construction and methods of homogenizing, and to devise especially a method of carrying out homogenization without appreciable occurrence of radial divergence to significant drop in homogenizing efficiency.

Another object of the invention is to devise a valve apparatus whose construction is such that it becomes possible to extrapolate the results and behavior obtained with one valve size and configuration to another similar configuration which may be made in a wide range of sizes and flow rates.

Still another object is to provide in a single valve structure a desirable adaptability to varying product requirements by providing an adjustable homogenizing aperture having adjustable wall components whose size and shape may be varied in accordance with varying product characteristics or flow rates.

With these objectives in mind, there has been devised a method of homogenizing based on the novel concept of moving a pressurized fluid through a homogenizing passageway along a substantially linear path of flow and in a pattern which may be likened to tiny streams of fluid passing through small parallel tubes closely adjacent to one another. It has been further determined that this concept may be practically implemented in a valve passageway in which all areas perpendicular to pressurized fluid flow are made equal and constant. To meet these conditions there is provided a valve having a homogenizing aperture which is characterized by similar inlet and outlet openings and a connecting passageway whose cross sectional area is constant at all points between the inlet and outlet openings. With a homogenizing aperture of this construction, it is found that there may be induced a substantially linear path of fluid flow to produce an energy release which is free from radial divergence and which is a function of the length of the passageway, the spacing of opposite side wall portions, and the pressure exerted.

For some products, a preferred form of the invention may include an impingement member or target which is mounted in predetermined spaced relation to the outlet opening of the aperture, and energized fluid is impacted against the surface of this target to carry out a further energy release and extend homogenizing efficiency.

BRIEF DESCRIPTION OF THE DRAWINGS

FIG. 1 is a side elevational view of one simple form of homogenizing valve of the invention having a slit type aperture.

FIG. 2 is a cross section taken on the line 2—2 of FIG. 1.

FIG. 3 is an elevational view of the opposite side of the valve illustrated in FIG. 1.

FIG. 4 is an enlarged fragmentary cross sectional view of another form of homogenizing valve apparatus.

FIG. 5 is a cross section taken on the line 5—5 of FIG. 4.

FIG. 6 is a cross section taken on the line 6—6 of FIG. 4.

FIG. 7 is a cross section taken on the line 7—7 of FIG. 4.

FIG. 8 is a schematic view of fluid processing apparatus for carrying out the method of the invention.

DETAILED DESCRIPTION OF THE INVENTION

Figure 9:
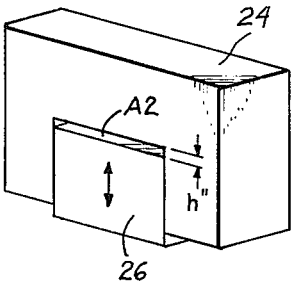
FIG. 9 is a perspective view of an adjustable valve construction.

The method of the invention is, in general, carried out by conducting a pressurized fluid through a homogenizing aperture or passageway of constant cross sectional area along a substantially linear path of flow with no appreciable radial divergence taking place. In one desirable mode, the linear flow type valve of the invention may, for example, have an aperture in the form of a slit, and the invention, although not limited thereto, will first be described with reference to a valve having a slit type aperture.

I have determined that if instead of utilizing a circular cross section passageway of varying diameter there is employed a relatively narrow homogenizing aperture which is constructed of a constant cross sectional area at all points between inlet and outlet openings of the passageway, there may be produced flow in a linear path of travel, and concurrently, an energy release which is a function of the spacing of two opposite wall portions of the passageway and the length of the passageway along which the fluid product travels.

I have further discovered by experimentation and testing that a passageway of this shape is subject to two limitations. First, the spacing of opposite wall portions which define the height of a passageway may vary with differing product characteristics, but is required to be held within a range of from about 0.001 inches up to about 0.050 inches. Secondly, the product travel distance, i.e., the length of the passageway, is required to lie in a range of from about 0.010 inches up to about 1 inch. Within these limitations, it is found that homogenizing efficiency of a new and practical nature may be achieved.

A valve structure first constructed and employed successfully to achieve homogenizing efficiency comparable or better than that ordinarily achieved with a valve aperture of circular cross section and varying diameters is illustrated in FIGS. 1 to 3, the valve structure shown removed from its conventional mounting structure and conduit connections. As shown in FIGS. 1 to 3, the valve structure, in one desirable embodiment, may be of rectangular shape and made of a solid metal body such as steel, denoted by the arrow V. Through this metal body is centrally located a homogenizing aperture A. Numeral 2 indicates an inlet side of the valve body and numeral 4 denotes the outlet side of the valve body. The inlet side 2 is recessed at 10 to provide a tapered entranceway which leads into an inlet opening 6 of aperture A. At the opposite end of aperture A is an outlet opening 8. The aperture is constructed with a constant cross sectional area at all points between the inlet opening 6 and the outlet opening 8. The height of aperture A is indicated by dimensional arrows *h*, as shown in FIGS. 1 and 3. The length of the aperture, i.e., product travel distance, is denoted by the dimensional arrows *l*, indicated in FIG. 2, The width of the passageway is denoted by dimensional arrows *w* as indicated in FIGS. 1 and 3.

As earlier noted, the height of the aperture and its length *l* must be held within limitations in order to provide for homogenizing efficiency of an acceptable nature. In the case of the height *h*, it must lie in a range of from 0.001 inches up to about 0.050 inches. For example, in homogenizing tests with the valve described, appreciable efficiency has been achieved with the spacing of 0.001 inches. Below this spacing, a very steep drop in efficiency to a point of no practical value is encountered. At about 0.002 inches good efficiency is achieved and reaches a maximum at about 0.003 inches. From 0.003 inches up to about 0.050 inches a plateau of maximum efficiency is realized. Above 0.050 inches spacing, an abrupt drop in efficiency occurs to a point of no practical value.

In the case of the product travel distance denoted by letter *l*, which in effect defines the time interval during which energy is released, the characteristics of the particular product to be processed largely determines at what point in the range of from 0.010 inches up to 1 inch the spacing is required to lie.

For example, in the rupture of yeast cells, bacterial cells, and the like, it is recognized in the art that an instantaneous release of the energy such as is accomplished by a knife-edge orifice is much more efficient than one in which the energy is released over a longer period of time. Conversely, in the homogenizing of dairy products, where a high level of energy is instantly released, the structure of the protein may be chemically altered, and there may result an undesirable homogenized product. Other types of emulsions and dispersions will require energy time levels between these two conditions.

With regard to the width *w* of the linear flow type aperture, virtually no limitation is present and this dimension may vary from a width of as little as 0.010 inches up to a width of 6 feet or more. However, an important feature of the invention resides in the extensibility of this dimension. With any given pressurized product whose travel distance and aperture height have been determined for a required efficiency level, it becomes possible to retain this efficiency level while increasing the output over a wide range of flow rates and pressures by making the dimension *w* of increasing magnitude.

Subject to the two dimensional limitations described, the linear flow type valve V may be mounted in a suitable retaining body in communication with a source of pressurized fluid as suggested diagrammatically in FIG. 8. The valve may be utilized with pressures ranging from 500 p.s.i. up to 12,000 p.s.i. As noted in FIG. 8, a supply of a fluid product desired to be homogenized is passed into a pumping apparatus capable of exerting pressures in the range noted, and this pressurized fluid is introduced into the valve body through the tapered entranceway formed by recessed side 10. Thereafter the pressurized fluid is conducted along the passageway of constant cross sectional area in a substantially linear path of flow, and a release of energy occurs as a function of the height *h* of the aperture A, its passageway length *l*, and the pressure exerted. From the valve V, the homogenized product is discharged outwardly in a linear path of travel to be received in a product container, also noted in FIG. 8.

Figure 20:
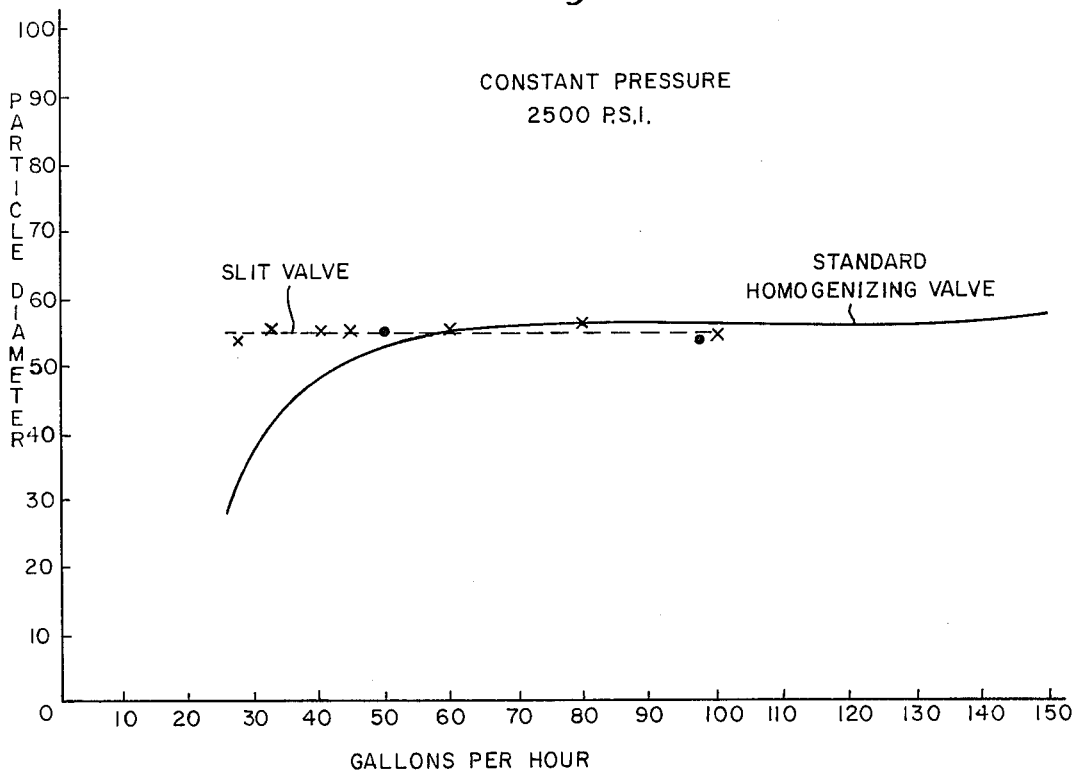
FIG. 20 is a diagrammatic view illustrating homogenizing efficiency curves for a standard type of homogenizing valve and one form of homogenizing valve of the invention.

As earlier disclosed, extensive testing of the linear flow type valve has been carried out. This experimentation has shown that homogenizing efficiency of a desirable nature is achieved and is superior in several respects to that of conventional circular cross section valves of varying diameter. This has been illustrated diagrammatically in part in FIG. 20. As is well known in the art, homogenizing efficiency drops off quite sharply with decrease in the flow rate below certain limitations with a constant pressure being maintained. This is illustrated diagrammatically by the solid line curve of FIG. 20 representing performance of a standard homogenizing valve. It will be noted that at a constant pressure of 2500 p.s.i., efficiency in terms of particle diameter reduction begins to fall away in a flow range of from 60 to 50 gallons per hour, and at 50 gallons per hour and below, an increasingly sharp drop in efficiency takes place.

In comparison with this, the broken line curve of FIG. 20 plotted with results of the linear flow type valve of the invention continues as a straight line at lower flow rates, and clearly indicates there is no drop in efficiency to any observable degree in a range of from 50 gallons per hour down to 20 gallons per hour and lower. This is a highly important and novel feature as it becomes possible to operate in a much wider range of flow rates and pressures without loss of efficiency or causing unpredictable changes.

A second advantage which has been observed with the linear flow type valve of the invention is a more uniform particle size reduction which tends to provide a more satisfactory product in many cases.

It should be understood that the fine performance characteristics of the linear flow type valve described may be achieved for some fluid products with an aperture whose dimensions are predetermined and fixed and utilized without other equipment. However, this linear flow type valve is highly versatile in that it may be combined with an impingement body to extend homogenizing efficiency and may itself be constructed with desirable adjustability features.

In this connection, attention is directed to FIG. 4 wherein is illustrated a conduit member 12 within which is sealably mounted by an O-ring 13 a valve body 14 formed of a cylindrical cross section and having provided therein a slit type aperture A1 which is constructed with dimensional limitations lying within the range of values earlier specified for aperture A and valve V. Also supported in the conduit 12 is an impingement body 16 mounted on a retainer structure 17 secured in the member 12 at a point downstream. The impingement body presents an impingement surface 18.

As indicated diagrammatically by the flow arrows at the left hand side of FIG. 4, pressurized fluid is introduced into the passageway defined by tapered side 10', and is then conducted in a linear path of flow through the aperture A1 along the passageway of length $l'$ and height $h'$. Homogenizing of a substantial nature takes place from energy release in this passageway. Fluid material thus energized is discharged outwardly in a continued linear path of flow 20, substantially free from radial divergence as indicated diagrammatically in FIG. 4 and FIG. 6, and is impacted against the impingement surface 18 with a further energy release taking place and homogenizing efficiency being extended. The constant linear configuration of the flow of discharged fluid is well confirmed by the fact that there is produced on the impingement surface 18 an area of wear $g$, indicated in FIG. 7, which is a mirror image of the cross sectional area 20, FIG. 6, of the linear flow of fluid.

When thus impacting the linear flow of fluid against the impingement surface 18, it will be understood that impingement is at an angle of 90° and it is found that the impingement surface may be adjustable and may have a spacing with respect to the outlet opening of valve body 14 in the order of from about 0.010 inches up to 0.050 inches to 0.100 inches.

It is pointed out that in using a standard homogenizing valve, it is well known that having an impingement surface surrounding the exit of the valve will improve the homogenizing efficiency. However, it is impossible to calculate the location of this surface for different valve sizes, flow rates, or products. This must be determined experimentally. With the linear flow type valve described, this distance, for a wide range of pressures, products and flow rates, may fall predictably in a range of from 0.050 inches up to 0.100 inches.

Figure 21:
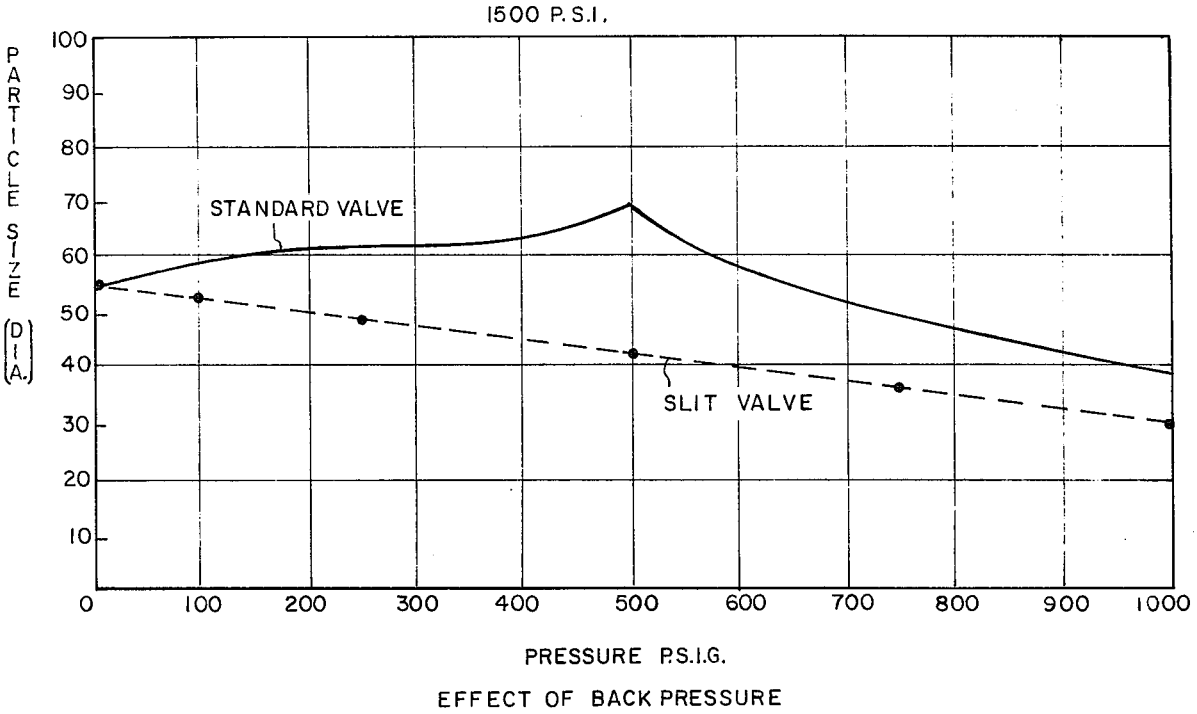
FIG. 21 is a diagrammatic view illustrating efficiency curves of a standard valve where back pressure is employed and one form of the invention subject to back pressure.

A further point of improved efficiency is concerned with back pressure. In a standard homogenizing valve, applying back pressure to the exit flow from the valve increases the homogenizing efficiency which peaks with a back pressure in the range of from 350 p.s.i. to 500 p.s.i., and then drops rapidly with any further increase in back pressure. With the linear flow type valve of the invention, there is a constant decrease in efficiency with increasing back pressure with any flow rate or product fluidity. This is evidenced by the solid line curve for a standard homogenizing valve illustrated in FIG. 21. It will be seen that this solid line peaks at about 500 p.s.i. with a flow pressure of 1500 p.s.i. In comparison the broken line curve of the invention valve is shown to decrease as a straight line with increasing pressures. From this it will be apparent that for best efficiency, in many cases, with a standard homogenizing valve, it is necessary to use controllable back pressure requiring suitable means for doing this. With the linear flow type valve, comparable efficiency is realized without controllable back pressure being maintained in a conduit member at the exit side.

As suggested above, the dimensions of the valve body and its homogenizing slit may be adjustable, and in FIGS. 9 to 13, inclusive, there are illustrated adjustable valve bodies of this nature. Thus FIG. 9 illustrates a valve body 24 having a slit type aperture A2 whose height $h''$ may be varied by adjusting the position of movable valve component 26 in the direction of the double arrow shown.

Figure 10:
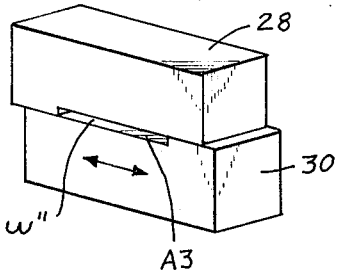
FIG. 10 is a perspective view of another type of adjustable valve construction.

In FIG. 10, a valve structure shown is made up of two components 28 and 30 which are adjustable with respect to one another to vary the width $w''$ of an aperture A3.

Figure 11:
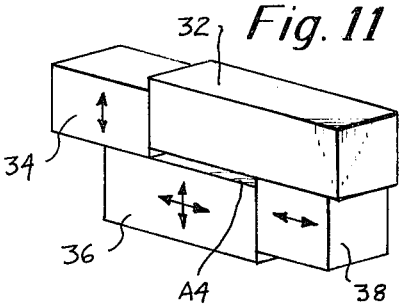
FIG. 11 is a perspective view of still another type of adjustable valve means.

In FIG. 11, there is illustrated a valve structure made up of valve components 32, 34, 36 and 38 to provide for adjustment of both the height and width of an aperture A4.

Figure 12:
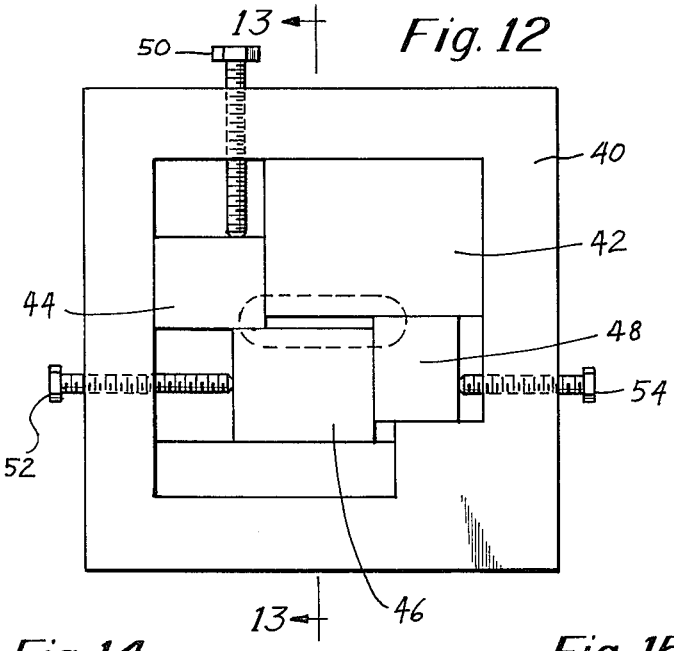
FIG. 12 is an elevational view of an adjustable valve mechanism with adjusting screw means.
Figure 13:
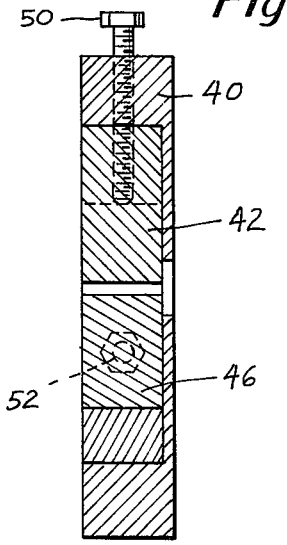
FIG. 13 is a cross section taken on the line 13—13 of FIG. 12.

As shown in FIGS. 12 and 13, the adjustability features illustrated diagrammatically in FIGS. 9 to 11 may be mechanically carried out by providing a valve block 40 and a fixed valve component 42 and movable components 44, 46 and 48 slidably engaged against one another while supported in the body 40 and adjustable by adjusting-screws 50, 52 and 54. Various other mechanical devices may be employed for varying the height and width of the slit, and in some cases, the length of the passageway of the slit.

Figure 14:
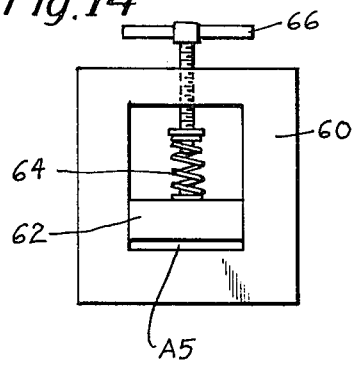
FIG. 14 is a perspective view of a modified valve structure, one of whose component parts is spring loaded.

It may also be desired to provide a valve body such as shown in FIG. 14, indicated by numeral 60 with an adjustable valve component 62 arranged to define an aperture A5 which is variable in height in accordance with the spring loading of a spring member 64 adjustable by means of a turn-screw 66. This arrangement may be desirable for certain types of products where appreciable fluctuation in pumping pressure in the flow line takes place. The purpose of the spring loaded components is to follow fluctuations in the pumping pressure in the actual spacing of the valve within the limitations which have been specified above.

Figure 15:
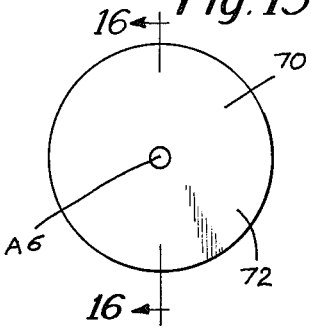
FIGS. 15, 16 and 17 illustrate another modification of valve structure.
Figure 16:
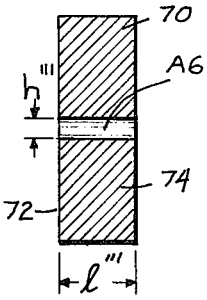
Figure 17:
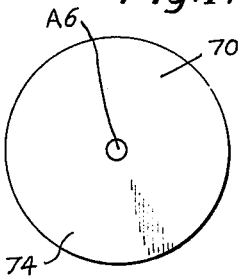
Figure 18:
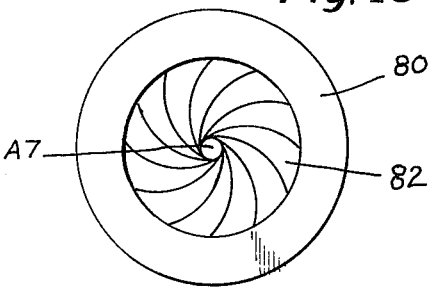
FIG. 18 illustrates in elevation a valve structure with orifice adjusting means.

The linear flow valve operation may also be carried out in some cases with some products by a valve body of circular form as shown in FIG. 15 and denoted by numeral 70. This valve is formed with homogenizing aperture A6 of circular configuration, but having similar inlet and outlet openings and a connecting passageway whose cross sectional area is constant at all points therealong, and opposite wall portions which have a spacing in a range of from 0.001 inches up to about 0.050 inches, and the product travel distance is limited to a range of from about 0.010 inches up to about 1 inch. The height of this valve is indicated at $h'''$, and the travel distance is indicated by $l'''$. Numeral 72 indicates the inlet side of the valve and 74 indicates the outlet side. It is contemplated that the aperture A6 may be constructed with an adjustable feature, and this has been indicated diagrammatically in FIG. 18, which shows a valve body 80 having adjustable iris-like components 82 for varying the size of a homogenizing aperture A7.

Figure 19:
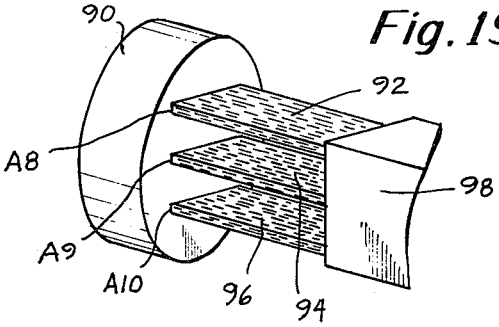
FIG. 19 is an elevational view of a valve construction which includes a plurality of slits.

In utilizing a valve body having an homogenizing aperture which produces a linear flow path of fluid, it may also be desired to provide a plurality of apertures in a single valve body occurring in spaced relation to one another, and in FIG. 19 there is illustrated a valve 90 having three homogenizing apertures A8, A9 and A10. Through these apertures a pressurized fluid is conducted and discharged in the form of thin sheets of energized fluid, as indicated at 92, 94 and 96, against an impingement member 98.

With the foregoing types of adjustable valve bodies described, it is found that the length, height, and width of linear flow type apertures can be scaled up or down for different flow rates and products. This cannot be done with standard homogenizing valves for reasons well known to those skilled in the art. It is important to recognize that in decreasing the valve size of a conventional valve, there is reached a point where a valve is mechanically unstable. This is not the case with the linear flow type of valve. It will also be appreciated that the variation and dwell time of produce, i.e., the length of the passageway, may also be readily changed as required.

I claim:

1. In a method of homogenizing fluid emulsions and dispersions, the steps which include introducing pressurized fluid in a range of pressures of from about 600 p.s.i up to 12,000 p.s.i. into a homogenizing valve member having a homogenizing aperture characterized by similar inlet and outlet openings and a connecting passageway whose cross sectional area is constant at all points therealong, said passageway being in the form of a slit and one of the wall portions defining the slit being adjustable with respect to an opposite wall portion, conducting the pressurized fluid through the passageway of constant cross sectional area to produce an energy release which is substantially free from radial divergence and which is a function of the length of said passageway the spacing of opposite wall portions thereof, and pressure exerted, and discharging the energized fluid from the outlet opening along a substantially linear path of flow, to provide homogenizing efficiency which is substantially constant throughout an extended range of flow rates.

2. In a method of homogenizing fluid emulsions and dispersions, the steps which include introducing pressurized fluid in a range of pressures of from about 500 p.s.i. up to 12,000 p.s.i. into a homogenizing valve member having a homogenizing aperture characterized by similar inlet and outlet openings and a connecting passageway whose cross sectional area is constant at all points therealong, said passageway being in the form of a slit and two wall portions defining the slit being adjustable, conducting the pressurized fluid through the passageway of constant cross sectional area to produce an energy release which is substantially free from radial divergence and which is a function of the length of said passageway the spacing of opposite wall portions thereof, and pressure exerted, and discharging the energized fluid from the outlet opening along a substantially linear path of flow, to provide homogenizing efficiency which is substantially constant throughout an extended range of flow rates.

3. In a method of homogenizing fluid emulsions and dispersions, the steps which include introducing pressurized fluid in a range of pressures of from about 500 p.s.i. up to 12,000 p.s.i. into a homogenizing valve member having a homogenizing aperture characterized by similar inlet and outlet openings and a connecting passageway whose cross sectional area is constant at all points therealong, said passageway being in the form of a slit and being provided with a resiliently supported wall portion which is responsive to fluctuation in pumping pressure of fluid conducted through the passageway, conducting the pressurized fluid through the passageway of constant cross sectional area to produce an energy release which is substantially free from radial divergence and which is a function of the length of said passageway the spacing of opposite wall portions thereof, and pressure exerted, and discharging the energized fluid from the outlet opening along a substantially linear path of flow, to provide homogenizing efficiency which is substantially constant throughout an extended range of flow rates.

4. Apparatus for homogenizing fluid emulsions and dispersions comprising pump means for supplying fluid under pressure in a range of about 500 p.s.i. to about 12,000 p.s.i., and a valve structure connected to the pump means and having a homogenizing aperture formed therein, said aperture being formed with sides which define a slit and at least one of the sides being adjustably mounted in the valve structure, said aperture presenting similar inlet and outlet openings and a connecting passageway whose cross sectional area is constant at all points therealong and whose opposite wall portions have a spacing which lies in a range of from 0.001 inches up to about 0.050 inches, and the passageway of constant cross sectional area being constructed of a length which is restricted to a range of from about 0.10 inches up to about 1 inch thereby to produce an energy release which is substantially free from radial divergence and is a function of the length of said passageway, the spacing of the said opposite wall portions and the pressure exerted.

5. Apparatus for homogenizing fluid emulsions and dispersions comprising pump means for supplying fluid under pressure in a range of about 500 p.s.i. to about 12,000 p.s.i., and a valve structure connected to the pump means and having a homogenizing aperture formed therein, said aperture being formed with sides which define a slit and at least one of the sides being resiliently supported in the valve structure, said aperture presenting similar inlet and outlet openings and a connecting passageway whose cross sectional area is constant at all points therealong and whose opposite wall portions have a spacing which lies in a range of from 0.001 inches up to about 0.050 inches, and the passageway of constant cross sectional area being constructed of a length which is restricted to a range of from about 0.10 inches up to about 1 inch thereby to produce an energy release which is substantially free from radial divergence and is a function of the length of said passageway, the spacing of the said opposite wall portions and the pressure exerted.

* * * * *